US005824977A

United States Patent [19]

Takano et al.

[11] Patent Number: 5,824,977

[45] Date of Patent: Oct. 20, 1998

[54] SLIDE SWITCH

[75] Inventors: Tsunesuke Takano; Kouichi Sinzawa; Yoji Yabata, all of Tokyo, Japan

[73] Assignee: Kabushiki Kaisha T an T, Tokyo, Japan

[21] Appl. No.: 798,908

[22] Filed: Feb. 12, 1997

[30] Foreign Application Priority Data

| | | | |
|---|---|---|---|
| Sep. 4, 1995 | [JP] | Japan | 8-111904 |
| Apr. 3, 1996 | [JP] | Japan | 8-073256 |
| Jul. 3, 1996 | [JP] | Japan | 8-079474 |
| Aug. 5, 1996 | [JP] | Japan | 8-137556 |

[51] Int. Cl.[6] ..... H01H 15/02

[52] U.S. Cl. ..... 200/16 C; 200/16 D

[58] Field of Search ..... 200/16 C, 16 D, 200/16 R, 16 F, 16 A, 16 B, 16 E, 51 R, 51.09, 51.1

[56] References Cited

U.S. PATENT DOCUMENTS

| | | | |
|---|---|---|---|
| 3,226,515 | 12/1965 | Concelman | 200/16 C |
| 4,417,107 | 11/1983 | Terajima | 200/16 C |
| 4,506,119 | 3/1985 | Tanabe . | |
| 5,043,540 | 8/1991 | Takano | 200/16 C |
| 5,051,549 | 9/1991 | Takano | 200/16 C |
| 5,345,372 | 9/1994 | Takano et al. | 200/16 C |
| 5,365,028 | 11/1994 | Takano | 200/16 R |

FOREIGN PATENT DOCUMENTS

| | | |
|---|---|---|
| 55-55469 | 12/1980 | Japan . |
| 57-10032 | 2/1982 | Japan . |
| 63-137421 | 9/1988 | Japan . |
| 3-8833 | 1/1991 | Japan . |
| 939461 | 10/1963 | United Kingdom . |

*Primary Examiner*—Khanh Dang
*Attorney, Agent, or Firm*—Nixon & Vanderhye PC

[57] ABSTRACT

A slide switch includes a moving contact contained within a slider that moves between a plurality of desired stationary contacts. A clicking thruster provided with resiliency by a resilient member such as a spring produces a clicking sensation during switching by engaging with clicking thruster recesses. A through hole is provided in the slider, and the moving contact is positioned within the through hole in opposition to the stationary contacts. The clicking thruster is positioned in opposition to the clicking thruster recesses, and the resilient member is fit in between the moving contact and the clicking thruster.

13 Claims, 18 Drawing Sheets

SLIDE SWITCH

BACKGROUND OF THE INVENTION

1. Field of the Invention

This invention relates to a slide switch suitable for use as a switch for turning on and off or switching an automobile interior lamp.

2. Description of the Prior Art

Examples of this type of slide switch of the prior art are described in Utility Model Laid-Open Publication No. 3-38833 previously proposed by the present applicant, as well as those described in Utility Model Examined Publication No. 57-10032 and Utility Model Examined Publication No. 55-55469 filed by other applicants. All of these slide switches employ a coil spring and plate spring, each of which is used independently as a spring for causing a moving contact to slide and make resilient contact with a stationary contact, and a spring for generating a clicking action during knob operation, namely a clicking sensation that is transmitted to the fingers that makes it feel like the switch has been switched to a different position.

However, in these examples of the prior art, a coil spring and plate spring are used, they are remarkably more disadvantageous than switches using a single spring that do not produce a clicking sensation in terms of parts management and ease of assembly, and also have the problem of increased costs.

Therefore, as a means of solving the above-mentioned problems, a switch is described in Utility Model Laid-Open Publication No. 63-137421 that produces a clicking sensation and applies pushing pressure to a moving contact and stationary contact with a single member. This slide is referred to as a clicking slide switch that uses a single plate spring material in which the two short and long pairs of opposing ends of four ends of a flat H-shaped plate spring material are respectively used for producing a clicking sensation and as moving contacts.

However, in this example of the prior art, in addition to having the shortcoming of being susceptible to defective contact and defective clicking due to the inherent "permanent fatigue" of the plate spring, since the switch is quite large in terms of its area, there is also the problem of it inhibiting the switch from being made smaller.

SUMMARY OF THE INVENTION

In order to solve the above-mentioned problems, the object of the present invention is to inexpensively and with ease of operation provide a slide switch that is compact in terms of its area and is able to provide a clicking sensation during switching. The switch applies pushing pressure to a stationary contact of a moving contact using a single resilient member by employing an assembly in which a clicking thruster and moving contact are respectively arranged in a row on both sides of a coil spring provided in a hole opened in the slider of the slide switch.

BRIEF DESCRIPTION OF THE DRAWINGS

These and other aspects and advantages of the present invention will be described in detail with reference to the accompanying drawings, in which.

DETAILED DESCRIPTION OF THE PREFERRED EMBODIMENTS

The following provides an explanation of a first embodiment of the slide switch as claimed in the present invention with reference to FIGS. 1 through 5.

Figure 1:
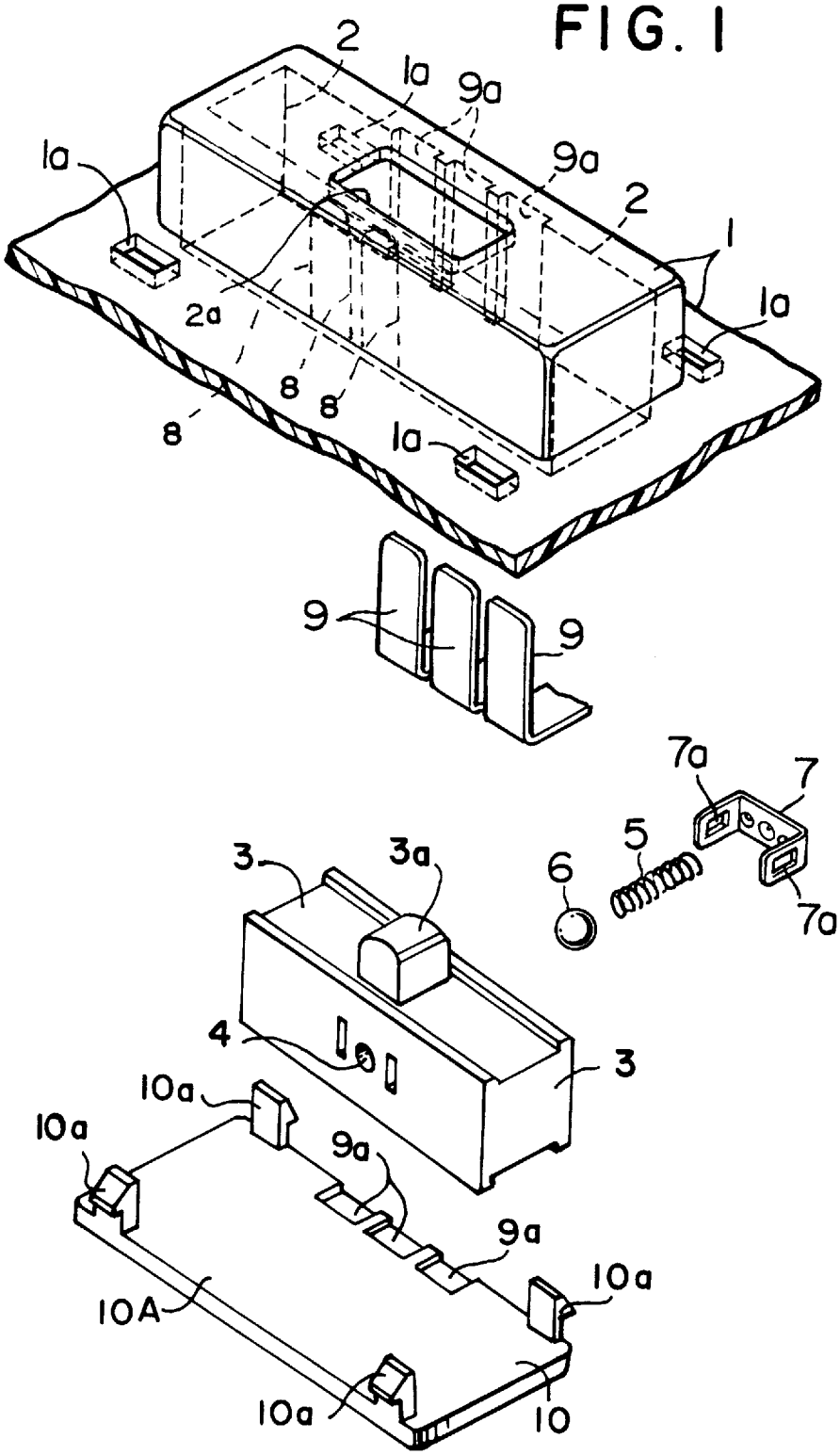
FIG. 1 is an exploded perspective view of the slide switch according to the present invention prior to its assembly.
Figure 2:
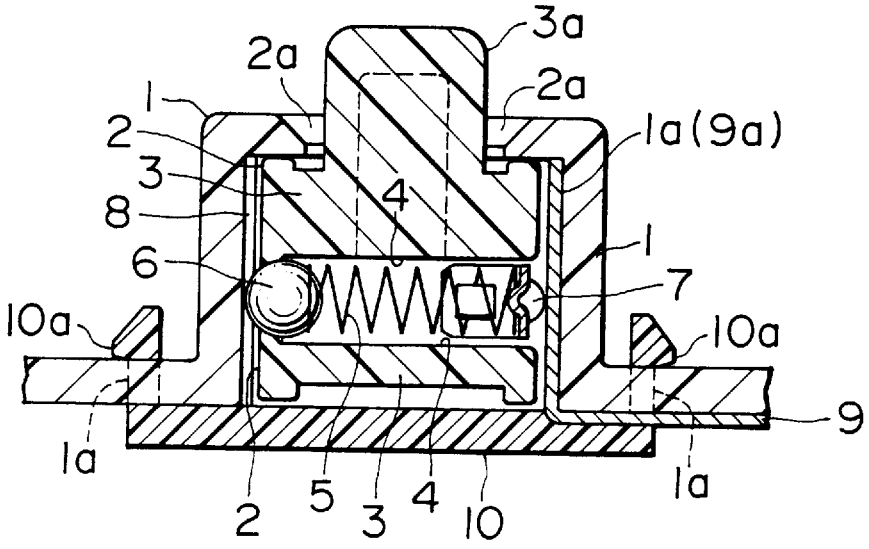
FIG. 2 is a longitudinal cross-sectional view of the above-mentioned slide switch after assembly.
Figure 3:
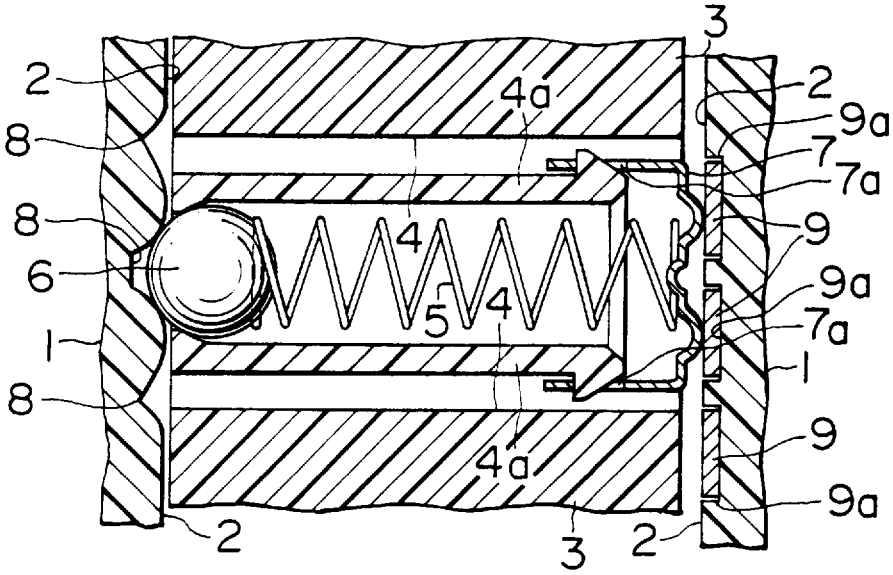
FIG. 3 is a cross-sectional overhead view of a slide switch after assembly.

In the construction of a slide switch equipped with a moving contact and clicking thruster on a slider 3 as shown in FIGS. 1 and 2, in the first embodiment, a relatively small hole 4, which is nearly perpendicular to the sliding direction, is formed in advance as shown in FIGS. 1 and 3 in the slider 3. The slider 3 is arranged so as to be able to slide as shown in FIG. 2 through a slot 2*a* with a knob 3*a* facing the outside, within a recess 2 of an insulating base 1 formed from plastic into a shape of a rectangular frame.

Within this hole 4, a clicking thruster 6, in the form of a steel ball and so forth, and a moving contact 7 are respectively arranged on both sides of a coil spring 5. The clicking thruster 6 and the moving contact 7 are arranged to respectively protrude from the slide 3 as shown in FIG. 3.

Figure 1A:
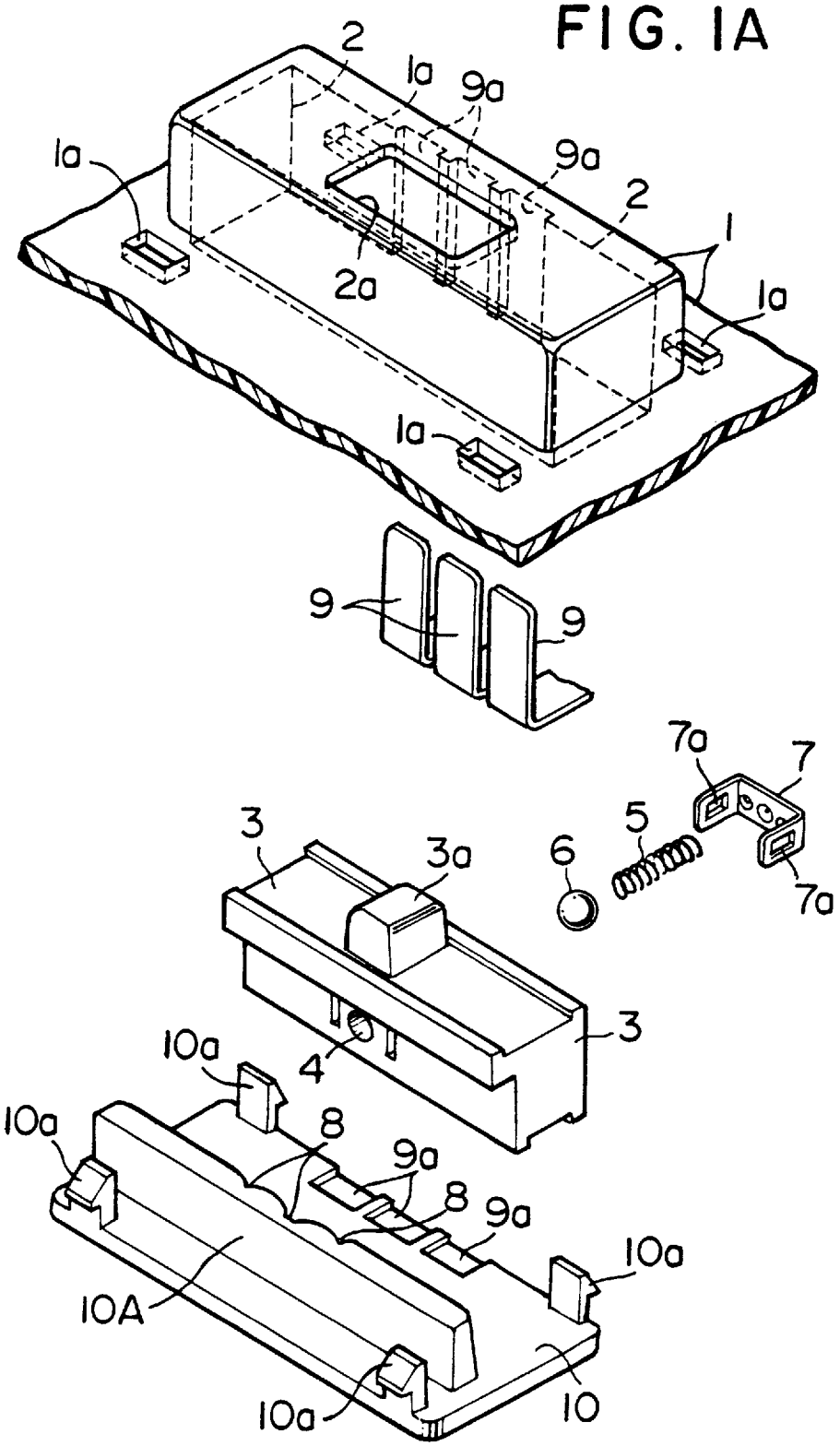
FIG. 1A illustrates an alternative arrangement.

The basic form of the slide switch according to the present invention is composed by the clicking thruster 6 and the moving contact 7 respectively making resilient contact with a clicking recess 8 and a plurality of stationary contacts 9 provided as shown in FIGS. 2 and 3 on the respective opposing inner surfaces of the recess 2. This structure serves to position the slider 3 within the recess 2 so as to be able to move as shown in FIG. 2. The opening edge of the recess 2 is covered with a cover plate 10 secured to the insulating base 1 with a plurality of locking hooks 10*a* and so forth. In an alternative arrangement, the clicking recesses 8 can be formed on a structural part 10A of the cover plate 10 as shown in FIG. 1A.

One end of the hole 4 of the slider 3 is formed smaller than the clicking thruster 6 to form a narrow end so that the clicking thruster 6 partially protrudes from the slider 3 but does not come out. Outward facing locking holes 7*a* are formed in the moving contact 7 as shown in FIG. 1 for engaging with end hooks of resilient locking tabs 4*a* disposed inside the hole 4 as shown in FIG. 3 in opposition to the resiliency of the coil spring 5. With this structure, automated assembly of this slide switch can be facilitated.

The clicking thruster 6 and the moving contact 7 tend to protrude at all times due to the resiliency of the coil spring 5, and the dimensions and so forth of the contact locking holes 7*a* are set so that they can be deflected toward the outer surface of the slider 3 in opposition to the resiliency of the coil spring 5.

In order to use this slide switch, in the slider position of FIG. 3, the moving contact 7 is juxtaposed about the first and second of three adjacent stationary contacts 9, and makes resilient contact due to the resiliency of the coil spring 5. Both of the first and second stationary contacts 9 are then in a state of electrical continuity by virtue of the connection effected by the moving contact 7. The clicking thruster 6 drops into the clicking recess 8 of recess 2 due to the resiliency of the coil spring 5. As a result, the above state of electrical continuity can be easily maintained without inadvertently moving the slider 3.

Figure 4:
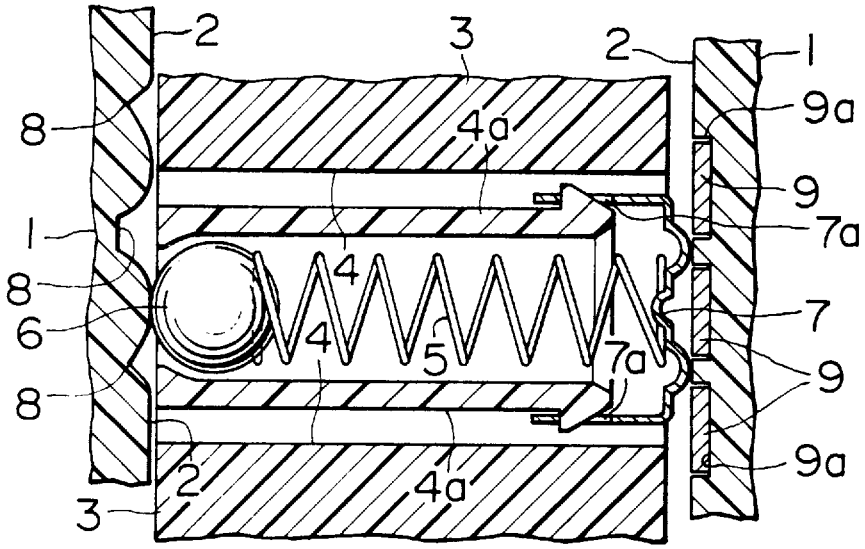
FIG. 4 is a cross-sectional overhead view showing a different state from that shown in FIG. 3.
Figure 5:
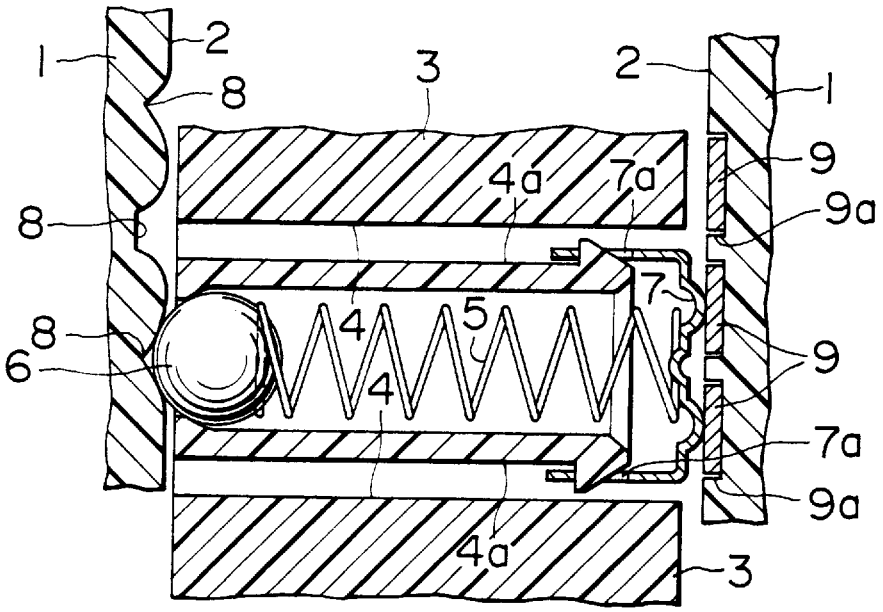
FIG. 5 is a cross-sectional overhead view showing a different state from that shown in FIG. 4.

Next, when the slider 3 is moved as shown in FIG. 5 through the state shown in FIG. 4 along slot 2*a,* the moving contact 7 is juxtaposed about the second and third adjacent stationary contacts 9 and makes resilient contact with the stationary contacts 9. As a result, the second and third stationary contacts 9 are in a state of electrical continuity by virtue of the connection effected by the moving contact 7. The clicking plunger 6 drops into another clicking recess 8 due to the resiliency of the coil spring 5, which in addition to providing the operator's fingers and so forth with a sensation of changing position, namely a clicking action, enables the slide 3 to easily maintain a state of electrical continuity after the clicking plunger 6 drops into the clicking recess 8.

Figure 6:
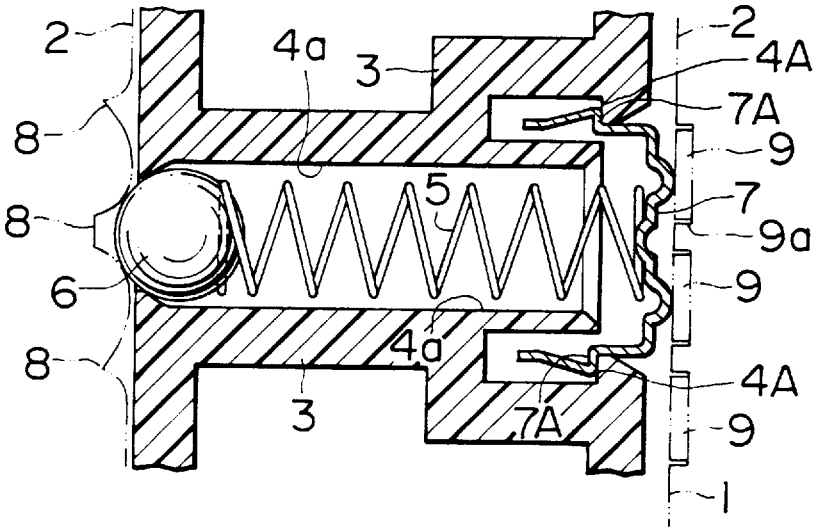
FIG. 6 is a cross-sectional overhead view showing another example of that shown in FIG. 3.

In the above-mentioned embodiment, although locking holes 7*a* are shown to prevent the end hooks of the resilient locking tabs 4*a* from coming out as a means of containing the moving contact 7 in the hole 4 of the slider 3, FIG. 6 shows an alternative example of mounting the moving contact 7 to the slider 3 to prevent it from coming out. Namely, the moving contact 7 is provided with locking flanges 7A to engage and lock onto locking tabs 4A provided protruding into the hole 4 of the slider 3 due to the inherent resiliency of the contact 7.

A simple sphere, hemisphere or bowl-shaped plunger can be used for the clicking plunger 6. Instead of aligning and arranging stationary contacts 9 with positioning grooves 9*a* provided in the inner surface of the recess 2, they may also be aligned and fixed in position with a known fixing means such as screws or adhesion. Moreover, instead of attaching and mounting the cover plate 10 as described above by aligning with the edges of the base locking holes 1*a* by its locking hooks 10*a,* the cover plate 10 can alternatively be made to attach to the base 1 with a known means such as screws.

Next, an explanation is provided of a second embodiment with reference to FIGS. 7 through 10. Those reference numerals that are the same as in the above-mentioned first embodiment indicate the same members, and their explanation is omitted.

Figure 7:
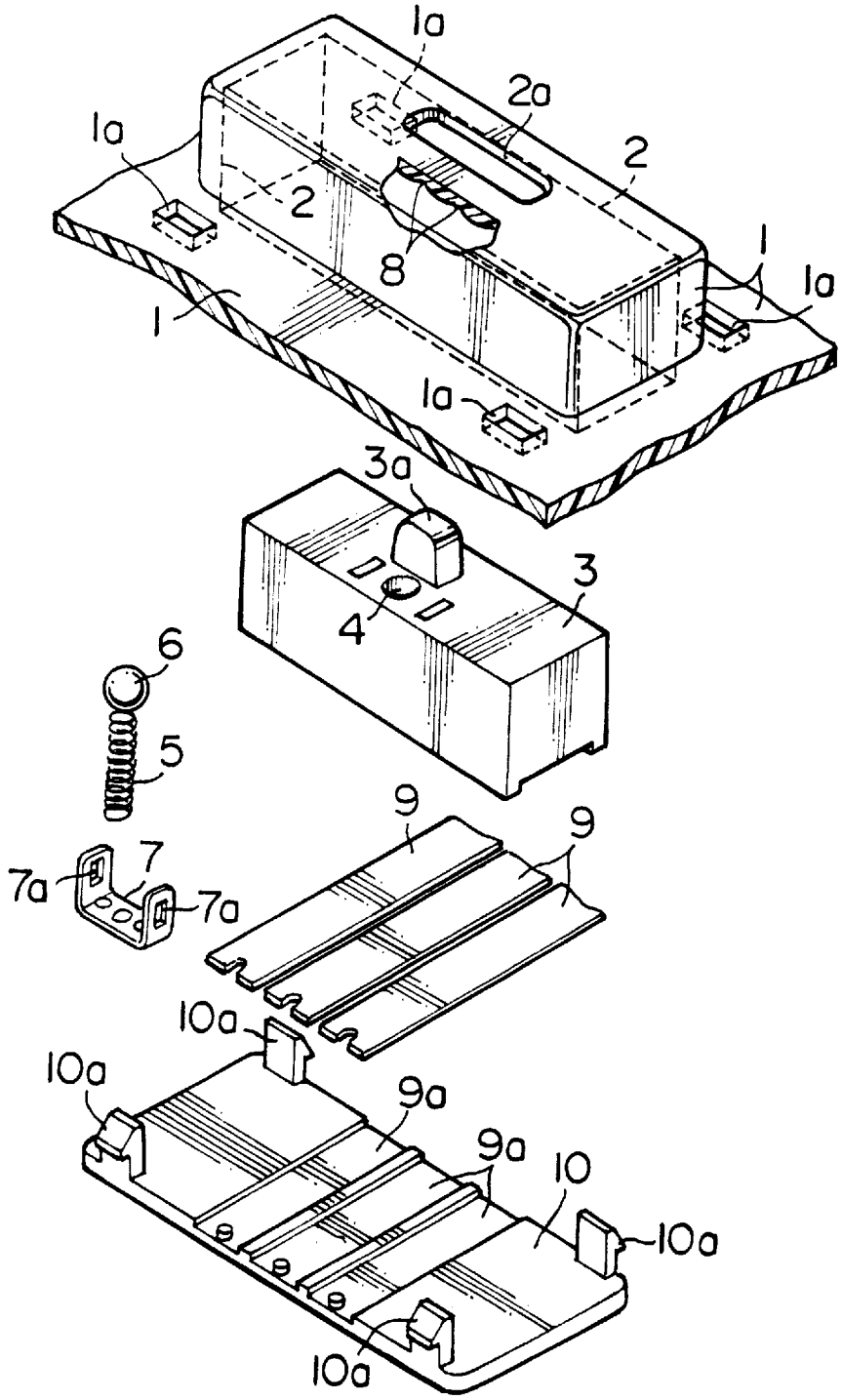
FIG. 7 is an exploded perspective view of a slide switch exhibiting a second embodiment prior to its assembly.
Figure 8:
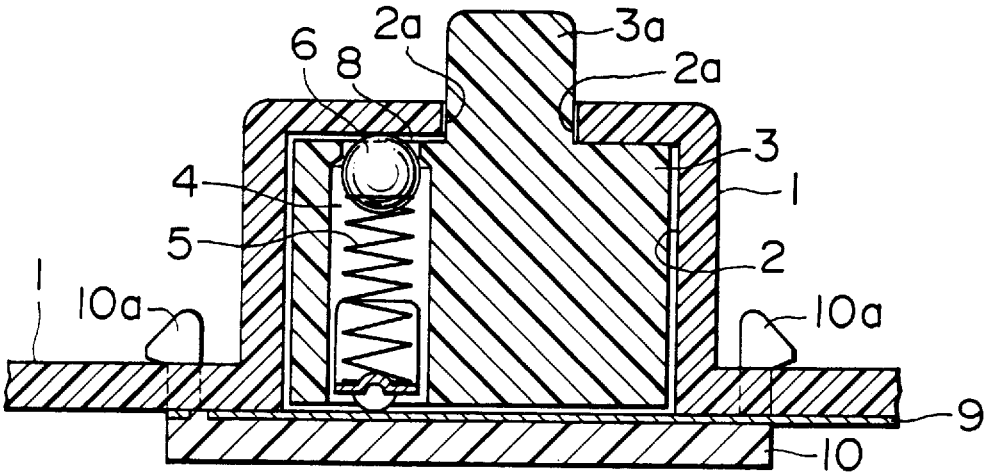
FIG. 8 is a longitudinal cross-sectional view of the above-mentioned slide switch after assembly.
Figure 9:
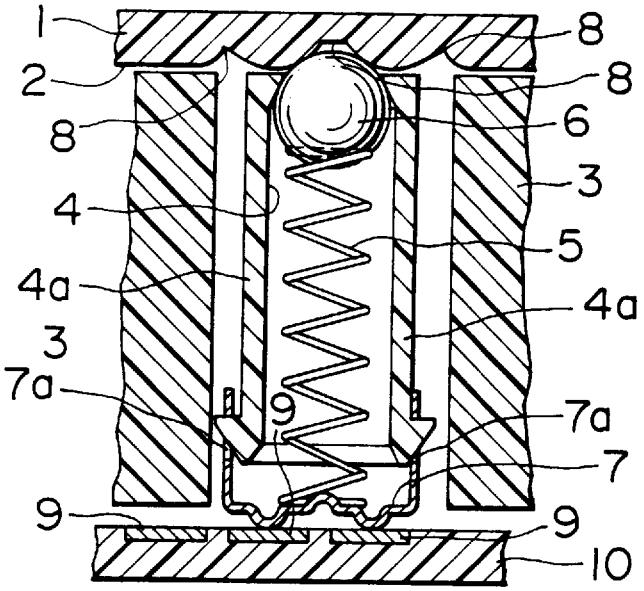
FIG. 9 is a cross-sectional overhead view of a slide switch after assembly.
Figure 10:
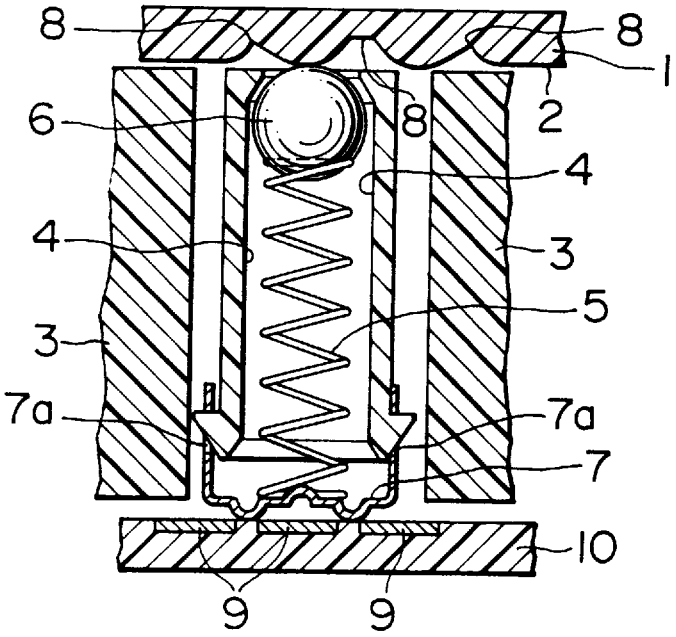
FIG. 10 is a cross-sectional overhead view showing a different state from that shown in FIG. 9.

In this embodiment, the relatively small hole 4, which is nearly perpendicular to the sliding direction, is formed as shown in FIGS. 7 and 9 in the slider 3. The slider 3 is arranged so as to be able to slide as shown in FIG. 8 through the slot 2*a* with the knob 3*a* facing the outside, within the recess 2 of the insulating base 1.

Within this hole 4, the clicking thruster 6 and the moving contact 7 are respectively arranged on both slides of the coil spring 5 as shown in FIG. 8.

The clicking thruster 6 and the moving contact 7 respectively make resilient contact as shown in FIGS. 7 and 9 with the clicking recesses 8 and the stationary contacts 9, respectively. The clicking recesses 8 are formed in the inner surface to the side of the slot 2*a* of the recess 2, and the stationary contacts 9 are arranged in opposition to the recesses 8. The opening edge of the recess 2 is covered with the cover plate 10 with the stationary contacts 9 in between through base locking holes 1*a* as shown in FIGS. 7 and 8 by using its locking hooks 10*a* and so forth.

As a result of the slide switch employing a constitution like that described above, in the slider position of FIG. 9, the moving contact 7 is juxtaposed about two adjacent stationary contacts 9 on the right side, and makes resilient contact to form a state of electrical continuity. The clicking thruster 6 drops into a center clicking recess 8 of the base recess 2 due to the resiliency of the coil spring 5. In addition to this producing a clicking action to the operator's fingers and so forth, the above-mentioned state of electrical continuity can be easily maintained without inadvertently moving the slider 3 after the clicking plunger 6 has dropped into the clicking recess 8.

Next, an explanation is provided of a third embodiment with reference to FIGS. 11 through 16. Those reference numerals that are the same as in each of the above-mentioned embodiments indicate the same members, and their explanation is omitted.

Figure 11:
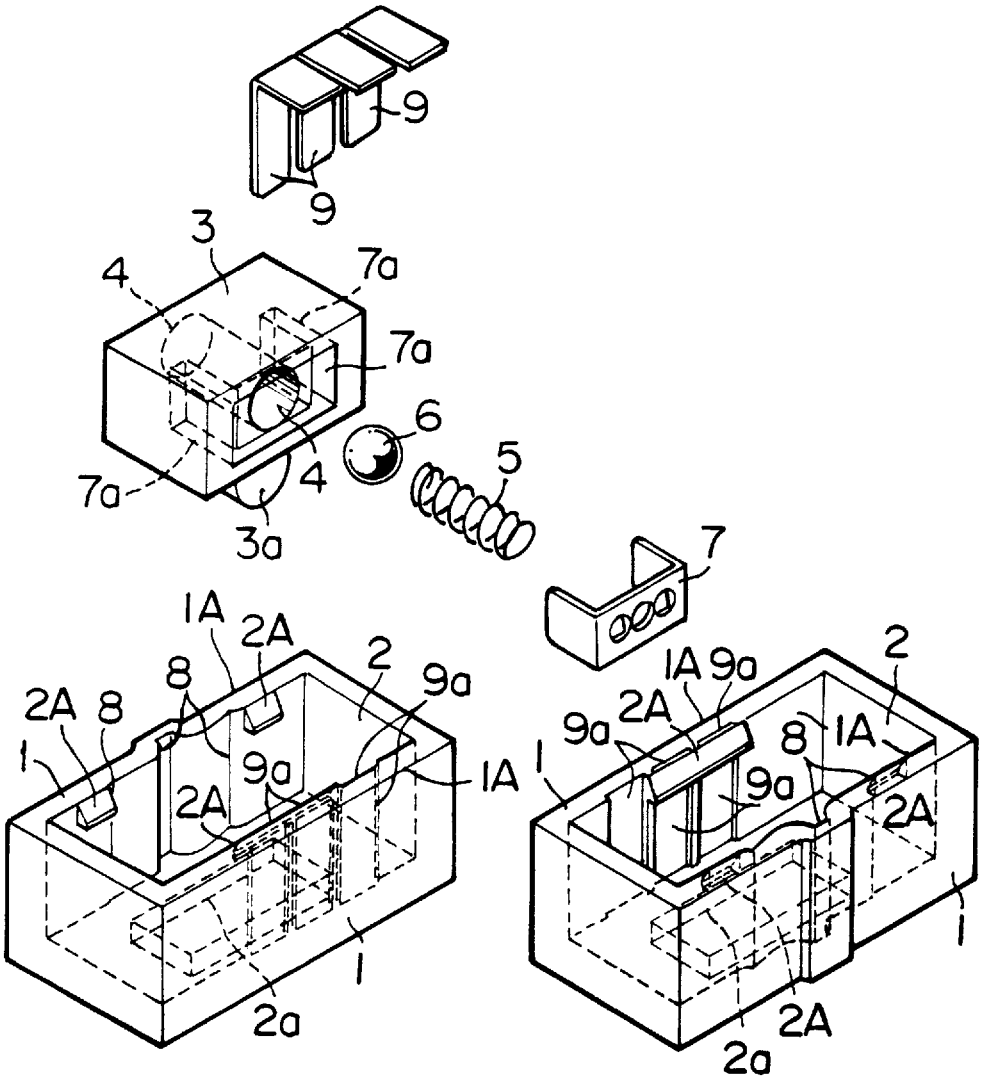
FIG. 11 is an exploded perspective view of a slide switch exhibiting a third embodiment prior to its assembly.
Figure 12A:
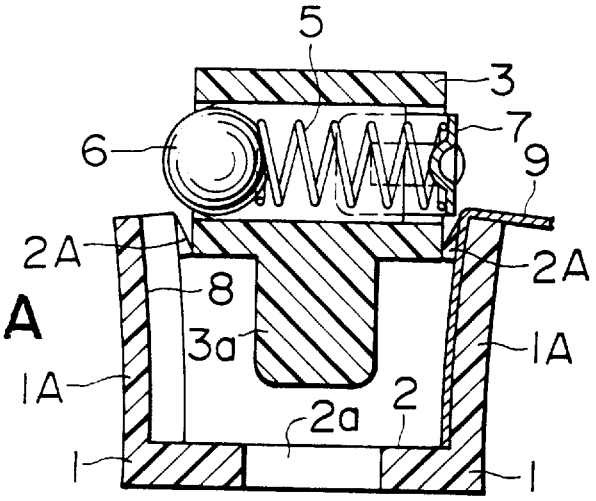
FIGS. 12(*a–d*) are longitudinal cross-sectional views of the above-mentioned slide switch both during and after assembly.
Figure 12B:
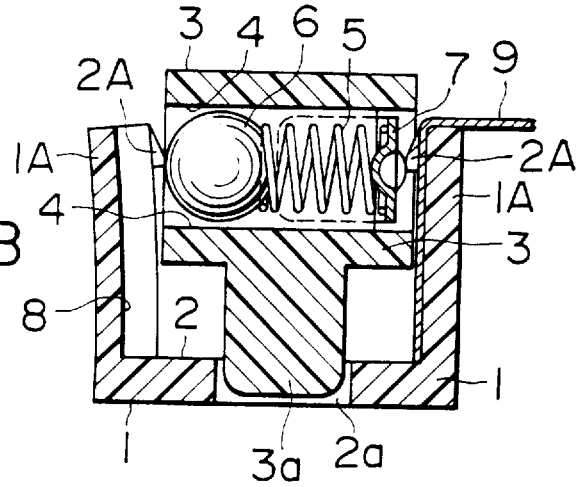
Figure 12C:
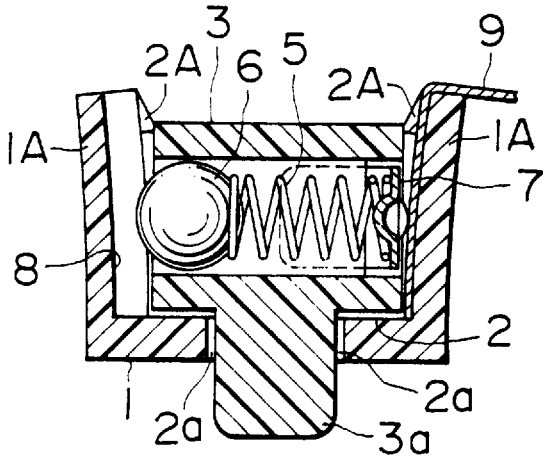
Figure 12D:
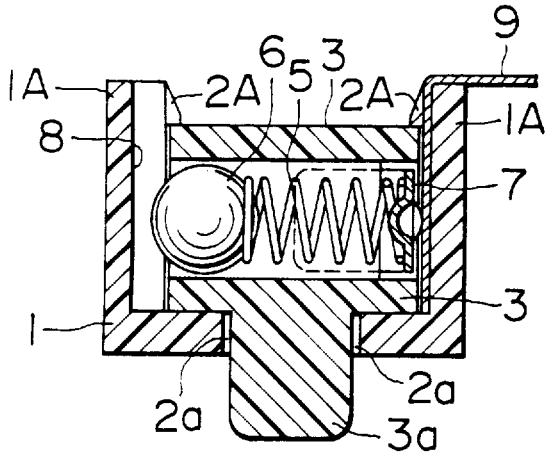

In this embodiment, the relatively small hole 4, which is nearly perpendicular to the sliding direction, is formed in advance as shown in FIGS. 11 and 12(*a–d*) in the slider 3. The slider 3 is arranged so as to be able to move as shown in FIGS. 12(*a–d*) through the slot 2*a* with the knob 3*a* facing the outside, within the recess 2 of the insulating base 1. The clicking thruster 6 and the moving contact 7, which is inserted into contact insertion holes 7*a,* are arranged in a row on both sides of the coil spring 5 in the hole 4.

When the slider 3 is first pushed into the recess 2 while juxtaposing the lower portion of the slider 3 about the inside inclined surfaces of locking tabs 2A provided protruding toward the opposing inner surfaces near the opening edge of the recess 2 as shown in FIG. 12(*a*), opposing frame pieces 1A are deflected outward in opposition to their resiliency due to this pushing force.

As a result, together with the gap between the locking tabs 2A increasing to the width of the slider 3 as shown in FIG. 12(*a*), the slider 3 can be pushed inward as shown in FIGS. 12(*b*) and (*c*) through the space between the widened locking tabs 2A. When the upper edge of the slider 3 has passed the locking tabs 2A, the opposing frame pieces 1A return to their original shape due to their own resiliency as shown in FIG. 12(*d*) thereby locking the slider 3 in position.

After returning in this manner, the slider 3 can be contained in the recess 2 while allowing it to move along the slot 2*a*. The locking tabs 2A prevent the slider 3 from coming out as shown in FIG. 12(*d*), and the clicking thruster 6 and the moving contact 7 make resilient contact with the clicking recesses 8 provided in the opposing inner surfaces of the recess 2 and the plurality of stationary contacts 9 arranged in positioning grooves 9*a* formed in opposition to this recess, respectively.

As a result of this slide switch employing a constitution as described above, in the slider position of FIG. 13, the moving contact 7 is juxtaposed about two adjacent stationary contacts 9 on the right side and makes resilient contact to form a state of electrical continuity between these stationary contacts 9 due to the resiliency of the coil spring 5. The clicking thruster 6 drops into the clicking recess 8 of the base recess 2 due to the resiliency of the coil spring 5, thus enabling the slide switch to easily maintain the above-mentioned state of electrical continuity without inadvertently moving the slider 3.

Figure 13:
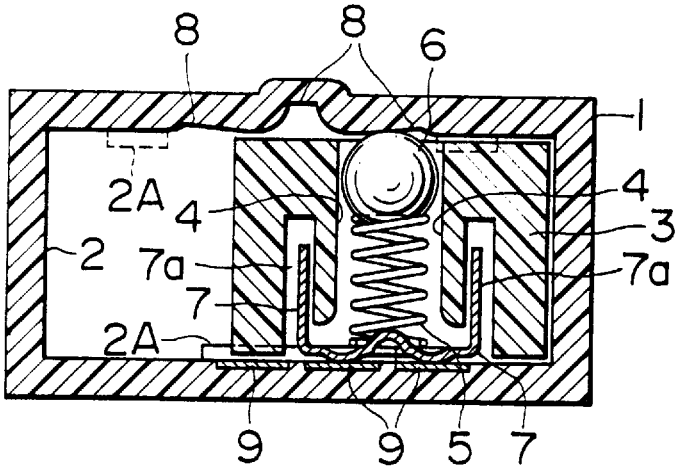
FIG. 13 is a cross-sectional overhead view of a slide switch after assembly.
Figure 14:
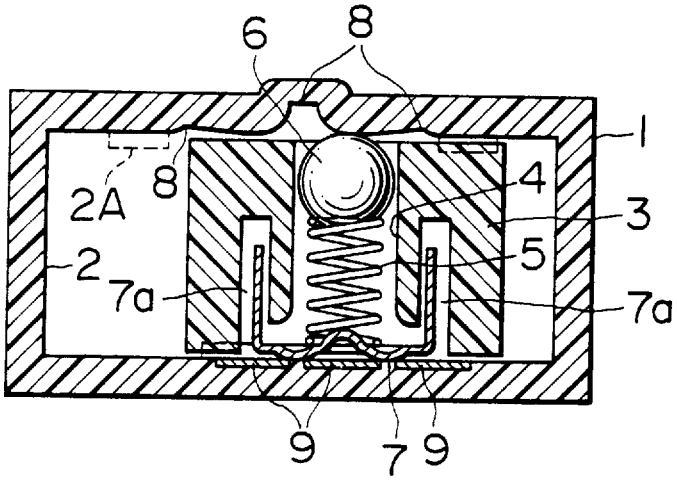
FIG. 14 is a cross-sectional overhead view showing a different state from that shown in FIG. 13.
Figure 15:
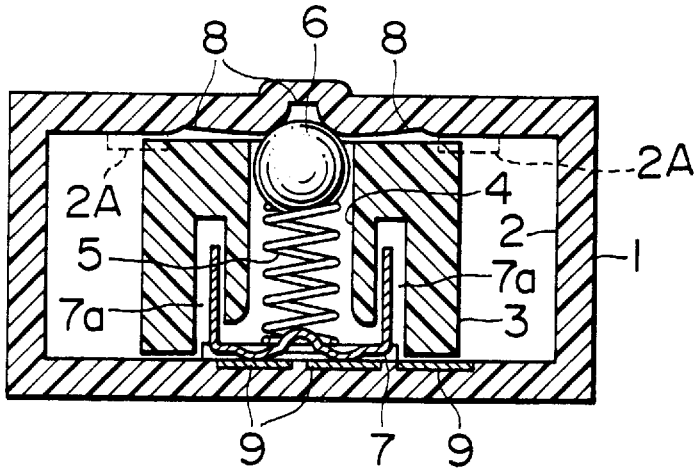
FIG. 15 is a cross-sectional overhead view showing a different state from that shown in FIG. 14.

When the slider 3 is moved as shown in FIG. 15 from the state of FIG. 14 along the slot 2*a* in opposition to the resiliency of the coil spring 5, the moving contact 7 is juxtaposed from the two adjacent stationary contacts 9 on the right side and makes resilient contact with the two stationary contacts 9 on the left side on FIG. 15 that differ from those in contact in FIG. 13. The clicking plunger 6 drops into the clicking recess 8 shown in FIG. 15 that differs from that of FIG. 13 due to the resiliency of the coil spring 5, which together with providing the operator's fingers and so forth with a clicking action, enables the slider 3 to easily maintain a state of electrical continuity.

Figure 16:
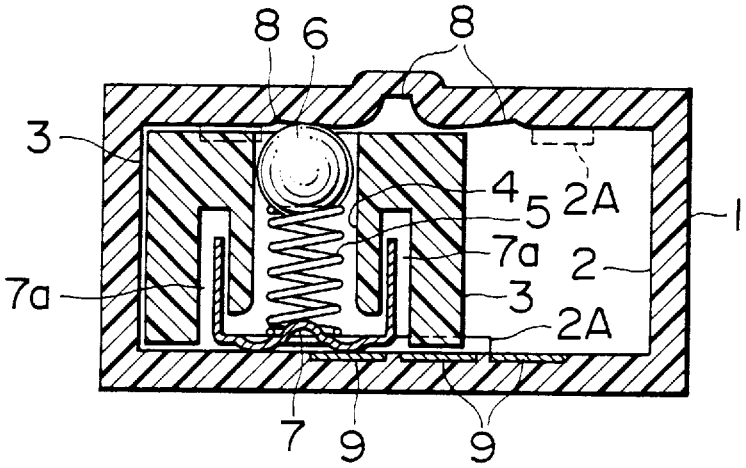
FIG. 16 is a cross-sectional overhead view showing a different state from that shown in FIG. 15.
Figure 17:
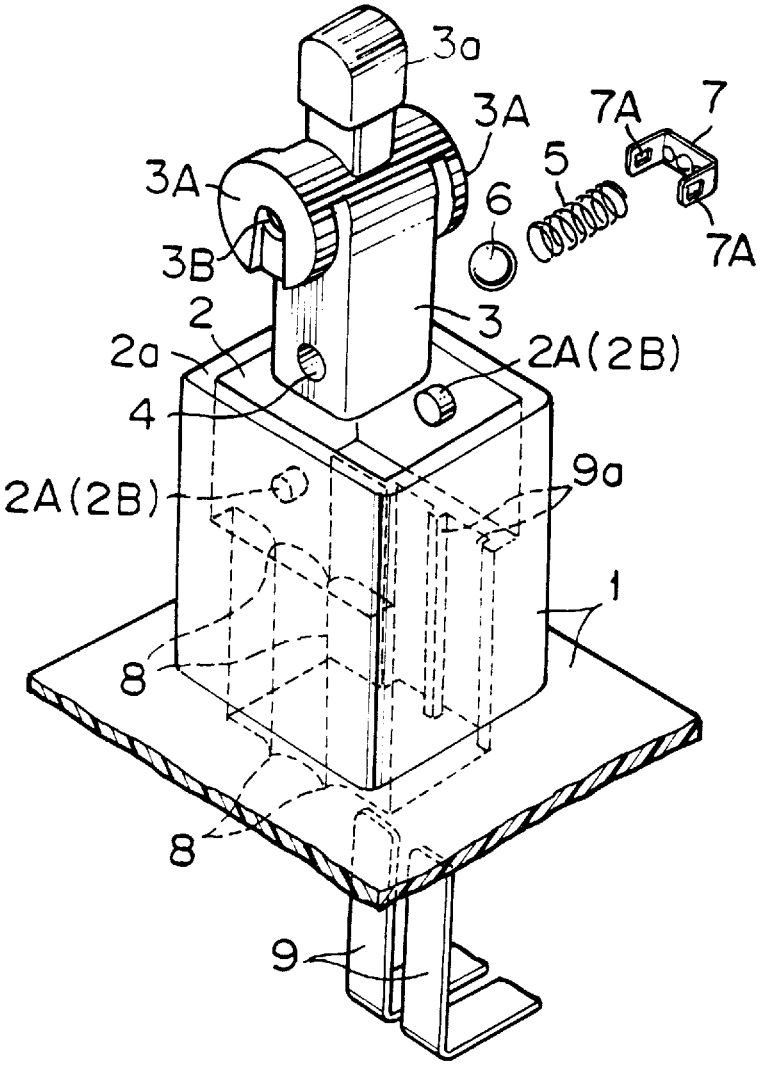
FIG. 17 is an exploded perspective view of an oscillating switch exhibiting a fourth embodiment prior to its assembly.

When the slider 3 is further moved to the left to the position shown in FIG. 16, the moving contact 7 forms an all-off state only making contact with a single stationary contact 9. This state can be easily maintained by the recess 8.

Next, an explanation is provided of a fourth embodiment with reference to FIGS. 17 through 21. Those reference numerals that are the same as in each of the above-mentioned embodiments indicate the same members, and their explanation is omitted.

In contrast to the above-mentioned embodiments performing switching of a switch by moving the slider 3 in horizontal directions, switching in this embodiment is performed by oscillating while using the slider 3 as a fulcrum.

In this embodiment, within the recess 2 of the frame 1, the operating lever 3 is arranged to pivot while allowing it to tilt back and forth through the opening edge 2*a* with the knob 3*a* facing the outside. The hole 4 is pre-formed nearly perpendicular to the direction of tilting by plastic molding. The clicking thruster 6 and the moving contact 7 are arranged in a row on both sides of the coil spring 5 inserted into the hole 4.

Figure 18A:
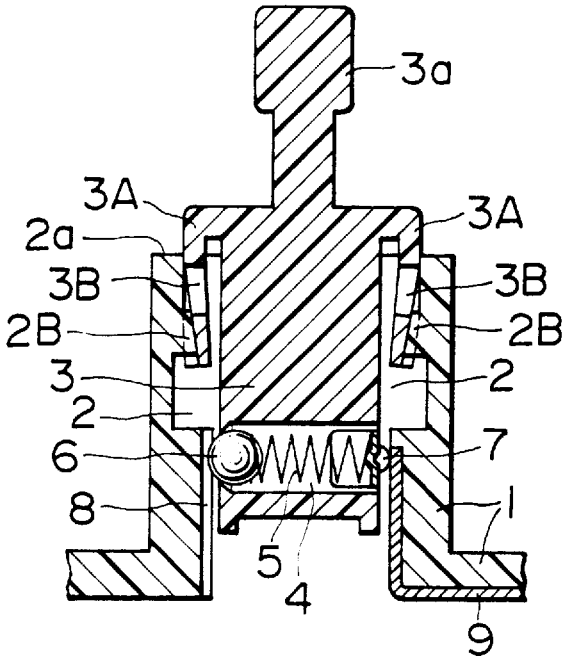
FIGS. 18(*a,b*) are longitudinal cross-sectional views of the above-mentioned switch during and after assembly.
Figure 18B:
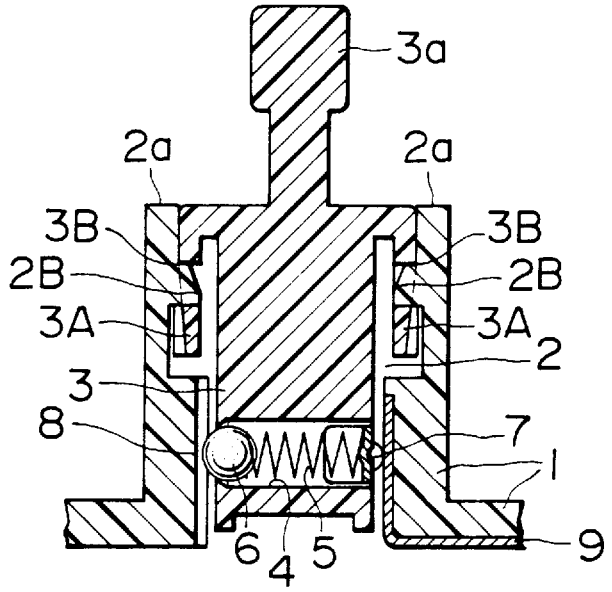
Figure 19:
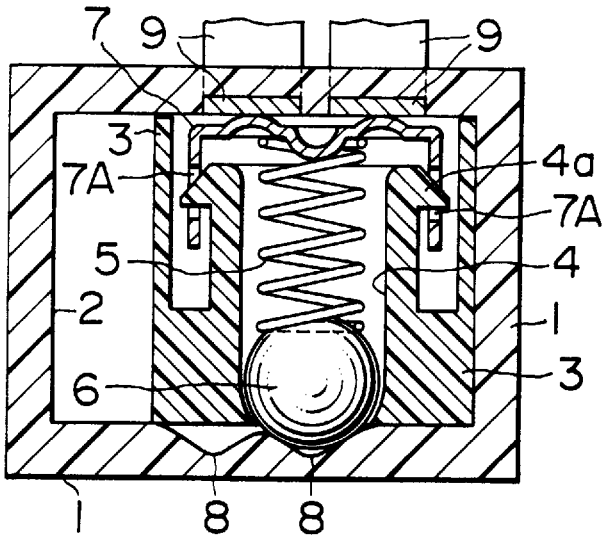
FIG. 19 is a cross-sectional overhead view used for explaining the operation of the oscillating switch of a fourth embodiment.
Figure 20:
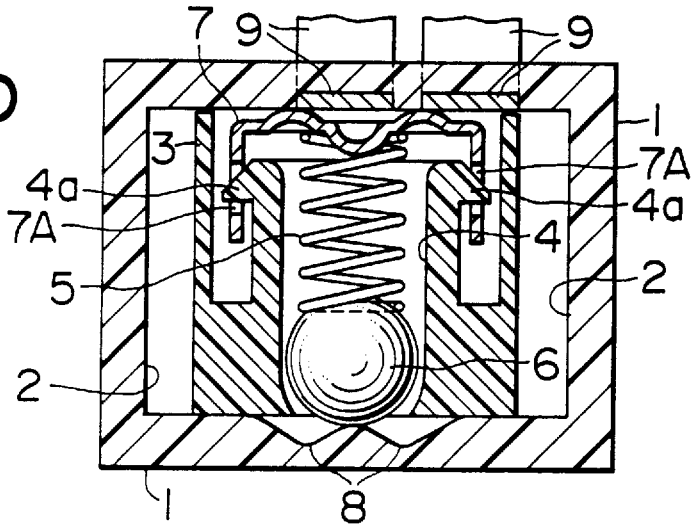
FIG. 20 is a cross-sectional overhead view showing a different state from that shown in FIG. 19.

In addition to pivotally supporting the above-mentioned operating lever 3 by pivoting support projections 3*a* engaged with pivot support portions 2A of the above-mentioned frame 1 by deflecting to the inside as shown in FIG. 18(*a*) in opposition to its resiliency, the clicking thruster 6 and the moving contact 7 make resilient contact with the clicking recesses 8 provided on the opposing inner surfaces of the recess 2 and the plurality of stationary contacts 9, arranged in opposition to the recesses 8, respectively, due to the resiliency of the coil spring 5.

The clicking thruster 6 and the moving contact 7 tend to protrude at all times due to the resiliency of the coil spring 5, and the depth and so forth of contact insertion holes 7*a* is set so that they can be pushed into the outer surface of the operating lever 3 in opposition to the resiliency of the coil spring 5. As one example of a means of pivotally supporting the operating lever 3, the operating lever 3 is pivotally supported within the frame recess 2 by engaging hinge bosses 2B of the inner surface of the frame recess 2 in hinge recesses (holes) 3B formed on the pivoting support projections 3A. After insertion, the pivoting support projections 3A resiliently return as shown in FIG. 18(*b*). In addition to being in the form of a hollow rectangle as in the previous example, the frame 1 may also be in the form of a combination of opposing plate pieces arranged with an opening in the middle.

In the case of a lever switch composed in the manner described above, in the lever position of FIG. 19, the moving contact 7 is juxtaposed about two adjacent stationary contacts 9, and makes resilient contact to form a state of electrical continuity between these stationary contacts 9 due to the resiliency of the coil spring 5. The clicking thruster 6 drops into the clicking recess 8 of the base recess 2 due to the resiliency of the coil spring 5, thus enabling the slide switch to easily maintain the above-mentioned state of electrical continuity without inadvertently moving the slider 3.

Figure 21:
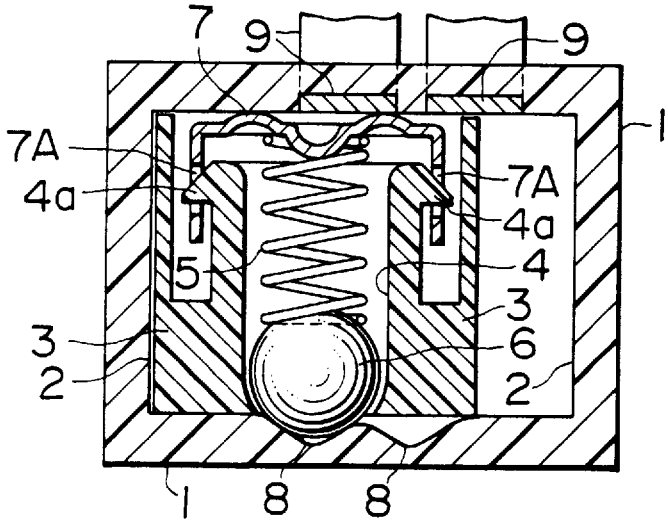
FIG. 21 is a cross-sectional overhead view showing a different state from that shown in FIG. 20.

When the operating lever 3 is tilted by grabbing onto the knob 3, using the hinge basses 2B as a fulcrum, and is tilted in opposition to the spring force of the coil spring 5 as shown in FIG. 21, the clicking thruster 6 then drops into the recess 8 on the left side in opposition to the resiliency of the coil spring 5. In addition to this creating a clicking sensation, the moving contact 7 is in the off state when it is in contact with only a single stationary contact 9, and this state can be easily maintained by the recess 8.

Figure 22:
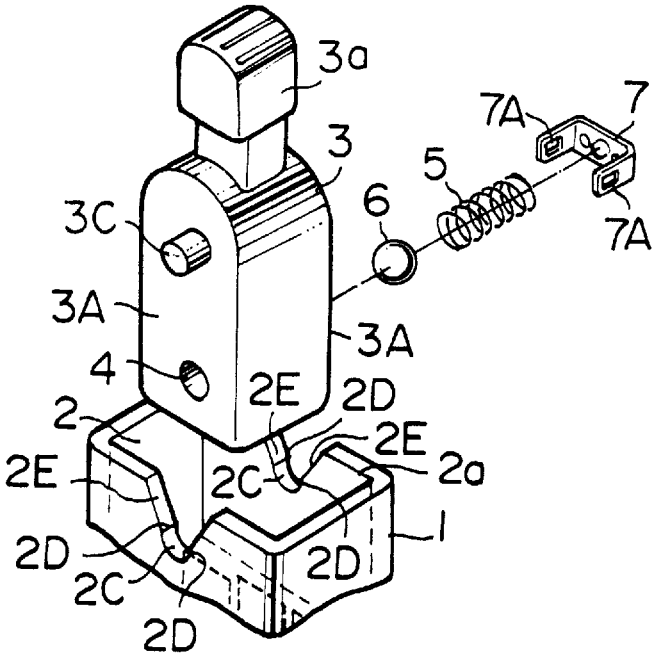
FIG. 22 is an exploded perspective view of an oscillating switch exhibiting another embodiment prior to its assembly.
Figure 24:
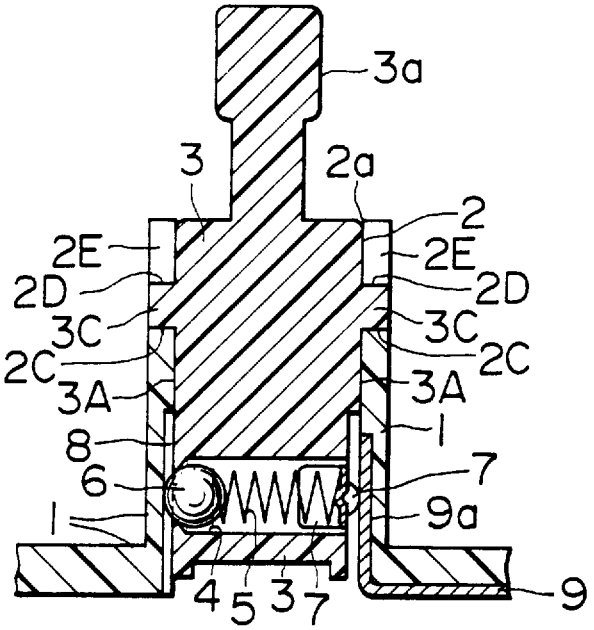
FIG. 24 is a longitudinal cross-sectional view of FIG. 22 after assembly.
Figure 23A:
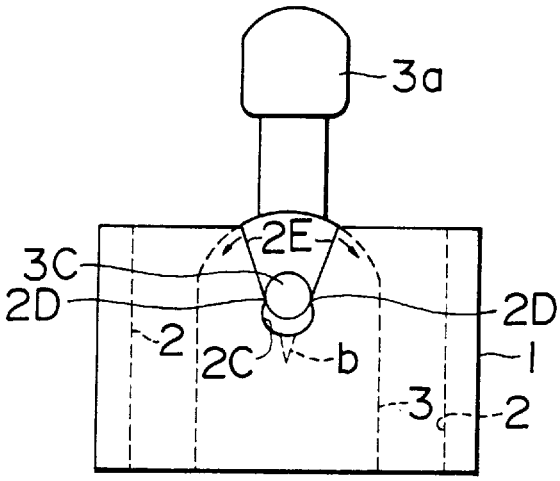
FIGS. 23(*a,b*) are side views of the pivoting support portion of the operating lever of the above-mentioned switch.
Figure 23B:
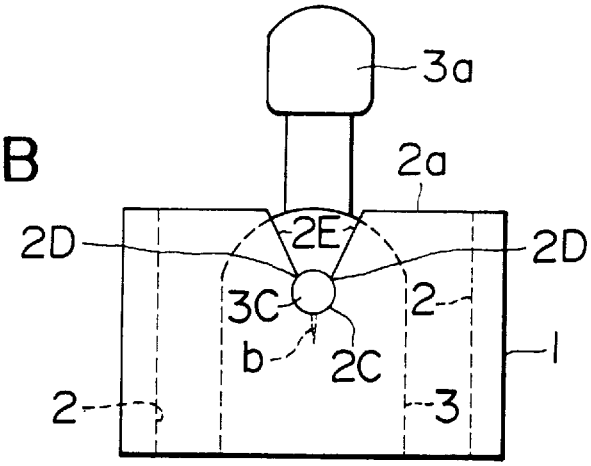

In the above-mentioned fourth embodiment, although the operating lever 3 is shown to be able to oscillate freely as a result of inserting the pivoting support projections 3A into the hinge bosses 2B formed within the recess 2 of the frame 1, the hinge bosses 3C formed on the operating lever 3 may resiliently fit into the hinge recesses 2C of the frame 1 as shown in FIGS. 22 through 24.

Namely, notches 2D, which are slightly narrower than the diameter of the hinge bosses 3C, are formed with guiding tapered portions 2E in the upper portion of the hinge recesses 2C of the frame 1. By sliding the hinge bosses 3C over the guiding tapered portions 2E and fitting into the hinge recesses 2C by means of the notches 2D, the hinge bosses 3C are able to rotate freely.

Although it is easier to fit the hinge bosses 3C into the notches 2D by providing deflection relief grooves b in the notches 2D, these relief grooves b are not necessary.

As has been described above, since the present invention provides a through hole in a slider, positions a moving contact within the through hole in opposition to stationary contacts, positions a clicking thruster in opposition to clicking thruster recesses, and fits a resilient member between the moving contact and the clicking thruster, the resilient member can be used both for clicking and for resilient contact by the moving contact with the stationary contacts. Since it is also able to provide a clicking sensation during switching, the present invention is able to have a simple structure, offer easy operation and be able to be provided inexpensively.

In addition, by forming a containment means for the clicking thruster while also forming a containment for the moving contact, the clicking thruster and moving contact can be mounted reliably and easily to the slider, thus improving the ease of assembly of the slide switch and promoting automated assembly.

Moreover, since the stationary contacts are positioned uniformly level by fitting into the grooves of the insulating base, the moving contact is able to move smoothly during sliding and oscillation of the slider, thus offering the advantage of smooth switching of the switch.

We claim:

1. A slide switch comprising:

a base defining a recess having a first inner surface and a second inner surface opposing said first inner surface;

a plurality of stationary contacts attached to said first inner surface;

a plurality of clicking recesses formed in said second inner surface;

a slider movably disposed in said recess, said slider including a through hole extending between said first and second inner surfaces;

a moving contact attached to said slider and coupleable with one or more of said plurality of stationary contacts based on a position of said slider;

a clicking thruster disposed in said through hole facing said second inner surface and being engageable with one of said plurality of clicking recesses based on a position of said slider; and a spring disposed in said through hole and positioned between said moving contact and said clicking thruster, said spring urging said moving contact toward said plurality of stationary contacts and urging said clicking thruster toward said plurality of clicking recesses.

2. A slide switch as set forth in claim 1 wherein a containment member that contains said clicking thruster is formed in one end of said through hole.

3. A slide switch as set forth in claim 2 wherein said containment comprises an end diameter of said through hole being smaller than said clicking thruster.

4. A slide switch as set forth in claim 1 wherein containment structure is formed in said through hole and on said moving contact.

5. A slide switch as set forth in claim 4 wherein said containment structure comprises locking holes, formed in bent portions bent at roughly a right angle from ends of said moving contact engaging with resilient locking tabs formed in said through hole.

6. A slide switch as set forth in claim 4 wherein said containment structure comprises locking projections, formed in bent portions of said moving contact, being locked in locking flanges formed in said through hole.

7. A slide switch as set forth in claim 1 wherein said through hole is formed in a direction perpendicular to a sliding direction of said slider.

8. A slide switch as set forth in claim 1 wherein said through hole is formed in a direction parallel to a sliding direction of said slider.

9. A slide switch as set forth in claim 1 wherein said stationary contacts are uniformly level by fitting into grooves of said base.

10. A slide switch as set forth in claim 1 further comprising a hinge, wherein said slider is axially supported by said hinge so that said slider oscillates relative to said base.

11. A slide switch as set forth in claim 1 wherein said clicking thruster is a steel ball.

12. A slide switch as set forth in claim 1, wherein a containment means of said clicking thruster is formed in one end of said through hole.

13. A slide switch comprising:

a base defining a recess having a first inner surface, a second inner surface opposing said first inner surface, and a slot disposed between the first and second inner surfaces and opening to outside of said recess;

a plurality of stationary contacts attached to said first inner surface;

a plurality of clicking recesses formed in said second inner surface;

a slider movably disposed in said recess, said slider including a through hole extending between said first and second inner surfaces and a knob extending through said slot;

a moving contact attached to said slider and coupleable with one or more of said plurality of stationary contacts based on a position of said slider;

a clicking thruster disposed in said through hole facing said second inner surface and being engageable with one of said plurality of clicking recesses based on a position of said slider;

a spring disposed in said through hole and positioned between said moving contact and said clicking thruster, said spring urging said moving contact toward said plurality of stationary contacts and urging said clicking thruster toward said plurality of clicking recesses; and a cover plate secured to said base and covering an opening in a side of said recess opposite from said slot.

* * * * *